US006922205B2

(12) United States Patent
Mogi

(10) Patent No.: US 6,922,205 B2
(45) Date of Patent: Jul. 26, 2005

(54) COLOR THERMAL PRINTER AND COLOR THERMAL PRINTING METHOD

(75) Inventor: Shusuke Mogi, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 141 days.

(21) Appl. No.: 10/358,200

(22) Filed: Feb. 5, 2003

(65) Prior Publication Data

US 2003/0146971 A1 Aug. 7, 2003

(30) Foreign Application Priority Data

Feb. 5, 2002 (JP) ..... 2002-028579

(51) Int. Cl.[7] ..... B41J 2/315
(52) U.S. Cl. ..... 347/171
(58) Field of Search ..... 347/171, 197, 347/215, 218–220; 400/612–613, 579, 618, 619, 633, 633.2, 614

(56) References Cited

U.S. PATENT DOCUMENTS 5,386,772 A 2/1995 Tolle et al.
5,847,742 A 12/1998 Nishimura
6,412,992 B2 * 7/2002 Mogi ..... 400/579
2001/0008596 A1 * 7/2001 Mogi ..... 400/578

FOREIGN PATENT DOCUMENTS

EP 1 036 662 A2 9/2000

* cited by examiner

*Primary Examiner*—K. Feggins
(74) *Attorney, Agent, or Firm*—Sughrue Mion, PLLC

(57) ABSTRACT

The printer has a conveyor roller pair and three thermal heads to record yellow, magenta and cyan images onto a recording sheet. The conveyor roller pair receives forward tension Ff from the forward tension roller pairs located near the thermal heads to pull the recording sheet with tension. A backward tension roller pair is provided to generate backward tension Fb to cancel forward tension Ff so that the recording sheet is conveyed at a stable conveyance speed. The coefficient of friction between the thermal head and the recording sheet is varied depending on the temperature, humidity and so force. Backward tension Fb is equal to Ef·α in consideration of the correction value α to correct variation in the coefficient of friction.

20 Claims, 5 Drawing Sheets

| | YELLOW RECORDING | MAGENTA RECORDING | CYAN RECORDING |
|---|---|---|---|
| FTRP (25) | Fy | Fy | Fy |
| FTRP (26) | 0 | Fm | Fm |
| FTRP (27) | 0 | 0 | Fc |
| Ff | Fy | Fy+Fm | Fy+Fm+Fc |
| Fb | Fy · α | (Fy+Fm) α | (Fy+Fm+Fc) α |

| | YELLOW RECORDING | MAGENTA RECORDING | CYAN RECORDING |
|---|---|---|---|
| FTRP (25) | Fy+Fr | Fy | Fy |
| FTRP (26) | 0 | Fm+Fr | Fm |
| FTRP (27) | 0 | 0 | Fc+Fr |
| Ff | Fy+Fr | Fy+Fm+Fr | Fy+Fm+Fc+Fr |
| Fb | (Fy+Fr) $\alpha$ | (Fy+Fm+Fr) $\alpha$ | (Fy+Fm+Fc+Fr) $\alpha$ |

COLOR THERMAL PRINTER AND COLOR THERMAL PRINTING METHOD

BACKGROUND OF THE INVENTION

1. Field of the Invention

The present invention relates to a color thermal printer and a color thermal printing method to convey a recording sheet and record a color image thereto, and more particularly to a color thermal printer and printing method to convey the recording sheet stably by decreasing tension applied to a conveyor roller pair.

2. Description Related to the Prior Art

A color thermosensitive printer, utilized as a color thermal printer, has a thermal head and a conveyor roller pair. While the conveyor roller pair conveys a color thermosensitive recording sheet (hereinafter referred to as recording sheet), the thermal head records a full-color image to the recording sheet. During the image recording, the thermal head presses the recording sheet and applies heat onto yellow, magenta and cyan thermosensitive coloring layers of the recording sheet.

There are various kings of the color thermosensitive printer, such as a three-pass type and a one-pass type. The three-pass type color thermosensitive printer has a single thermal head, and conveys the recording sheet forward and backward by three times to record a full color image. On the other hand, the one-pass type color thermosensitive printer has plural thermal heads to record a color image while the recording sheet is conveyed forward once, thereby it takes shorter time to record an image than the three-pass type printer. Thus, the one-pass type thermosensitive printer is suitable for business use that requires sequential image recording.

The one-pass type color thermosensitive printer, however, have to move thermal heads successively to press the recording sheet in accordance with the conveyance. Pressing the recording sheet increases tension to the recording sheet and the conveyor roller pair. Increase in tension changes the conveyance speed of the recording sheet, which causes unevenness in the recorded image. In order to prevent unevenness, the color printer described in EP 1 036 662 A2 (corresponding to JP-A 2000-263864, equivalent to U.S. Pat. No. 6,474,886) provides a set of tension rollers near thermal heads to apply tension. The tension roller changes tension to the recording sheet when the leading end of the recording sheet passes the thermal head in the downstream side, so as to prevent fluctuation in tension to the recording sheet.

FIG. 7 shows a relationship between the conveyance speed and tension to the conveyor roller pair. In order to convey the recording sheet stably, it is necessary to keep the tension with in a stable range shown in FIG. 7, which is found to be about ±1 kgf according to experiments. The drive power of the conveyor roller pair is so strong that forward tension to the conveyor roller pair easily exceeds the narrow stable range, even if grid rollers are used as the conveyor roller pair.

Moreover, the coefficient of friction is variable depending on image density, temperature, humidity and so forth. Fluctuation in the load to the conveyor roller pair because of forward tension and the coefficient of friction causes change in the conveyance speed of the recording sheet. In that case, the recording position of each line is shifted to cause unevenness in the recorded image.

SUMMARY OF THE INVENTION

An object of the present invention is to convey a recording sheet at a certain speed by keeping tension applied to a conveyor roller pair within a range not to influence the conveyance speed.

To achieve the above objects, the color thermal printer of the present invention has plural forward tension roller pairs and a backward tension roller pair. Each of the forward tension roller pairs is provided in the downstream side of the thermal head. The forward tension roller pair nips and applies forward tension to the recording sheet to convey it to the downstream side. The backward tension roller pair, provided in the upstream side of the conveyor roller pair, applies backward tension to decrease said forward tension. Since the recording sheet is conveyed stably at a certain speed, it is possible to prevent fluctuation in recording position of the image.

In a preferred embodiment, the forward tension roller pairs are located near the yellow, magenta and cyan thermal heads, and apply forward tension Fy, Fm, Fc, respectively. A controller controls torque to the forward tension roller pairs and the backward tension roller pair, so that backward tension Fb becomes substantially equal to the sum of forward tension (Fy+Fm+Fc). The controller increases torque to the backward tension roller pair when the forward tension roller pair nips said recording sheet one by one.

The coefficient of friction between the thermal head and the recording sheet is variable in accordance with image density, temperature and humidity. If the coefficient of friction is varied, the recording position is changed to cause unevenness in the recorded image. Thus, the controller changes torque to the backward tension roller pair in accordance with image density, temperature and/or humidity.

During the image recording, the recording sheet is nipped between the thermal heads and the platen rollers. The controller may rotate the platen rollers to generate forward tension to the recording sheet. In that case, it is possible to omit the forward tension roller pairs.

BRIEF DESCRIPTION OF THE DRAWINGS

The above objects and advantages of the present invention will become easily understood by one of ordinary skill in the art when the following detailed description would be read in connection with the accompanying drawings.

PREFERRED EMBODIMENTS OF THE INVENTION

Figure 1:
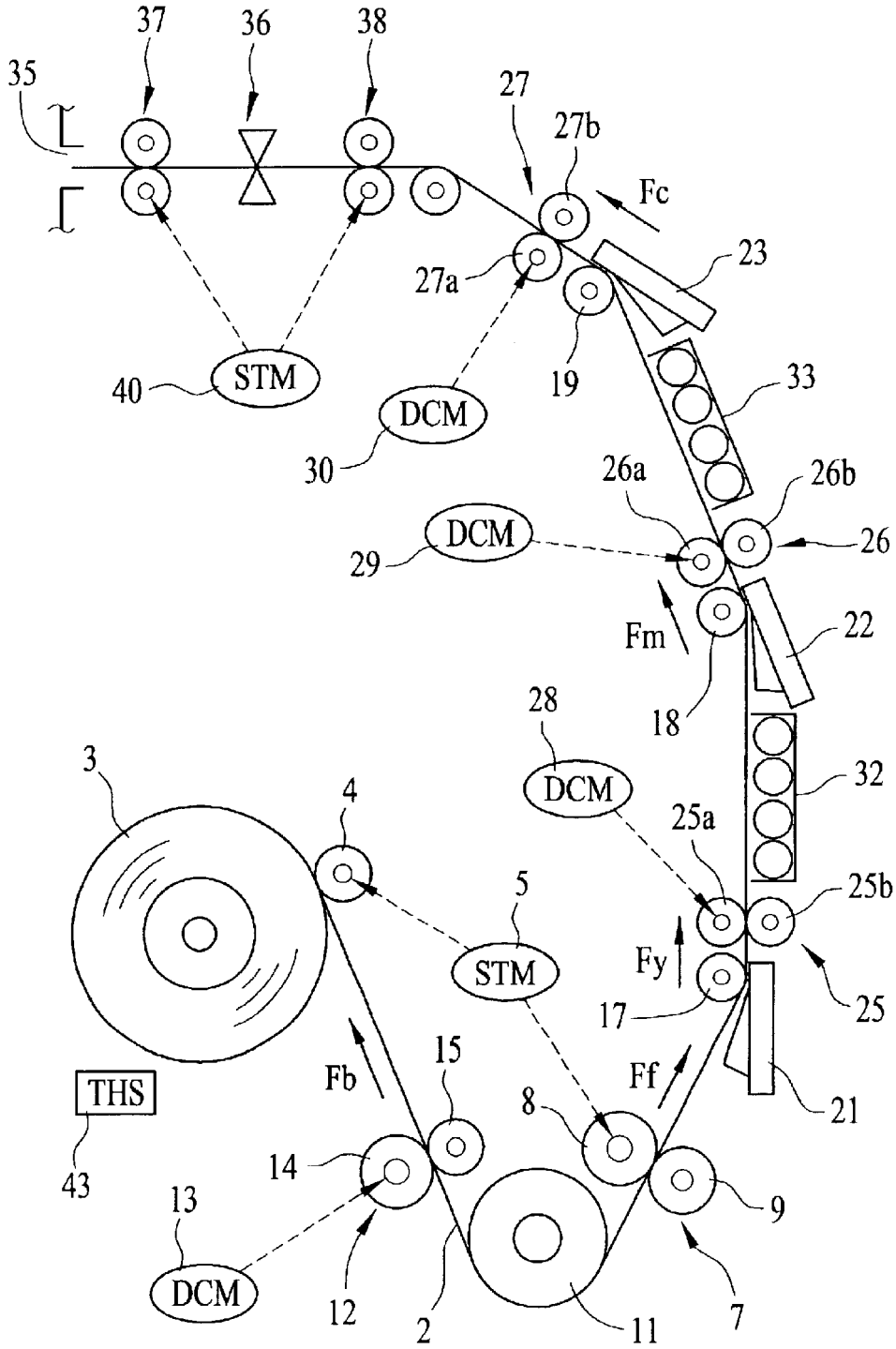
FIG. 1 is a schematic view showing a color thermosensitive printer of the present invention.

Referring to FIG. 1, a color thermosensitive printer records a color image onto a continuous color thermosensitive recording sheet (recording sheet) 2. The recording sheet 2 is tightly wound around a core of a recording sheet roll 3 that is loaded in a feeding section of the color thermosensitive printer. The outermost layer of the recording sheet roll 3 is pressed by a feeding roller 4 that is driven by a stepping motor (STM) 5. The feeding roller 4 rotates to pull the leading end of the recording sheet 2 out of the recording sheet roll 3 toward a conveyance passage of the color thermosensitive printer. After an image is recorded, the recording sheet 2 is pulled back to the recording sheet roll 3 to prevent unnecessary exposure to ambient light and humidity.

The recording sheet 2 has cyan, magenta and yellow thermosensitive coloring layers on a substrate in this order listed. The yellow thermosensitive coloring layer is the outermost layer, and has a largest thermal sensitivity among the three coloring layers. The yellow thermosensitive coloring layer loses its coloring ability by irradiation of near ultraviolet rays having a peak about 420 nm. The cyan thermosensitive coloring layer, the innermost layer, has a smallest thermal sensitivity. The magenta thermosensitive coloring layer has a thermal sensitivity between those of the yellow and cyan thermosensitive coloring layers. The magenta thermosensitive coloring layer loses its coloring ability by irradiation of ultraviolet rays with a peak about 365 nm. The recording sheet 2 has a black thermosensitive coloring layer.

A conveyor roller pair 7 is located in the conveyance passage to nip and convey the recording sheet 2. The conveyor roller pair 7 consists of a capstan roller 8 driven by the stepping motor 5, and a pinch roller 9 that is movable between a position to press the capstan roller 8 and a position away from the capstan roller 8. The color thermosensitive printer has a shift mechanism (not shown) to move the pinch roller 9.

A correction roller 11 is disposed between the feeding roller 4 and the conveyor roller pair 7 to correct deviation of the recording sheet 2 in the widthwise direction. The color thermosensitive printer has a backward tension roller pair (BTRP) 12 to give backward tension to the recording sheet 2. The BTRP 12, located in the upstream side of the correction roller 11, includes a capstan roller 14 activated by a DC motor (DCM) 13 and a pinch roller 15 to nip the recording sheet 2 with the capstan roller 14. The pinch roller 14 is movable by a shift mechanism (not shown) between a position to press the capstan roller 14 and a position away from the capstan roller 14.

In the downstream side of the conveyor roller pair 7 with respect to the conveyance of the recording sheet 2, there are yellow, magenta and cyan thermal heads 21, 22, 23 each of which has a linear heating element arrays. The heating element arrays of the thermal heads 21, 22, 23 are pressed onto the recording sheet 2 on corresponding platen rollers 17, 18, 19, and heated to record yellow, magenta and cyan images respectively in the yellow, magenta and cyan thermosensitive coloring layers of the recording sheet 2.

A shift mechanism (not shown) is provided to move the thermal head 21, 22, 23 between respective recording positions and respective retract positions. The heating element array is pressed onto the recording sheet 2 when the thermal head is at the recording position, and is away from the corresponding platen roller at the retract position.

The color thermosensitive printer has forward tension roller pairs (FTRP) 25, 26, 27 in the downstream side of respective thermal head 21, 22, 23. The FTRP 25 includes a capstan roller 25*a* activated by a DC motor 28 and a pinch roller 25*b* that is movable by a shift mechanism (not shown) between a position to press the recording sheet 2 on the capstan roller 25*a* and a position away from the capstan roller 25*a*. The FTRPs 26, 27 include capstan roller 26*a*, 27*a* and pinch rollers 26*b*, 27*b* that are activated by DC motors 29, 30, respectively.

A yellow fixation lamp 32 is provided between the yellow and magenta thermal heads 21, 22. The yellow fixation lamp 32 emits near-ultraviolet rays with a peak about 420 nm to fix the yellow thermosensitive coloring layer of the recording sheet 2. A magenta fixation lamp 33, provided between the magenta and cyan thermal heads 22, 23, emits ultraviolet rays having a peak about 365 nm to fix the magenta thermosensitive coloring layer.

A cutter roller pair 38, a cutter 36 and an ejection roller pair 37 are arranged between the cyan thermal head 23 and an ejection slot 35. The ejection roller pair 37 and the cutter roller pair 38 are actuated by a stepping motor (STM) 40. The cutter roller pair 38 conveys the recording sheet 2 toward the cutter 36. When an image recording area of the recording sheet 2 passes the cutter 36, the cutter 36 is activated to cut the recording sheet 2 into a sheet print of certain length. The ejection roller 37 conveys the sheet print toward the ejection slot, so that the sheet print is ejected outside of the color thermosensitive printer.

The temperature and humidity in the printer is monitored by a temperature and humidity sensor (THS) 43 disposed near the recording sheet roll 3. The THS 43 generates temperature and humidity signal and sends it to a controller 48 of the printer.

Figure 2:
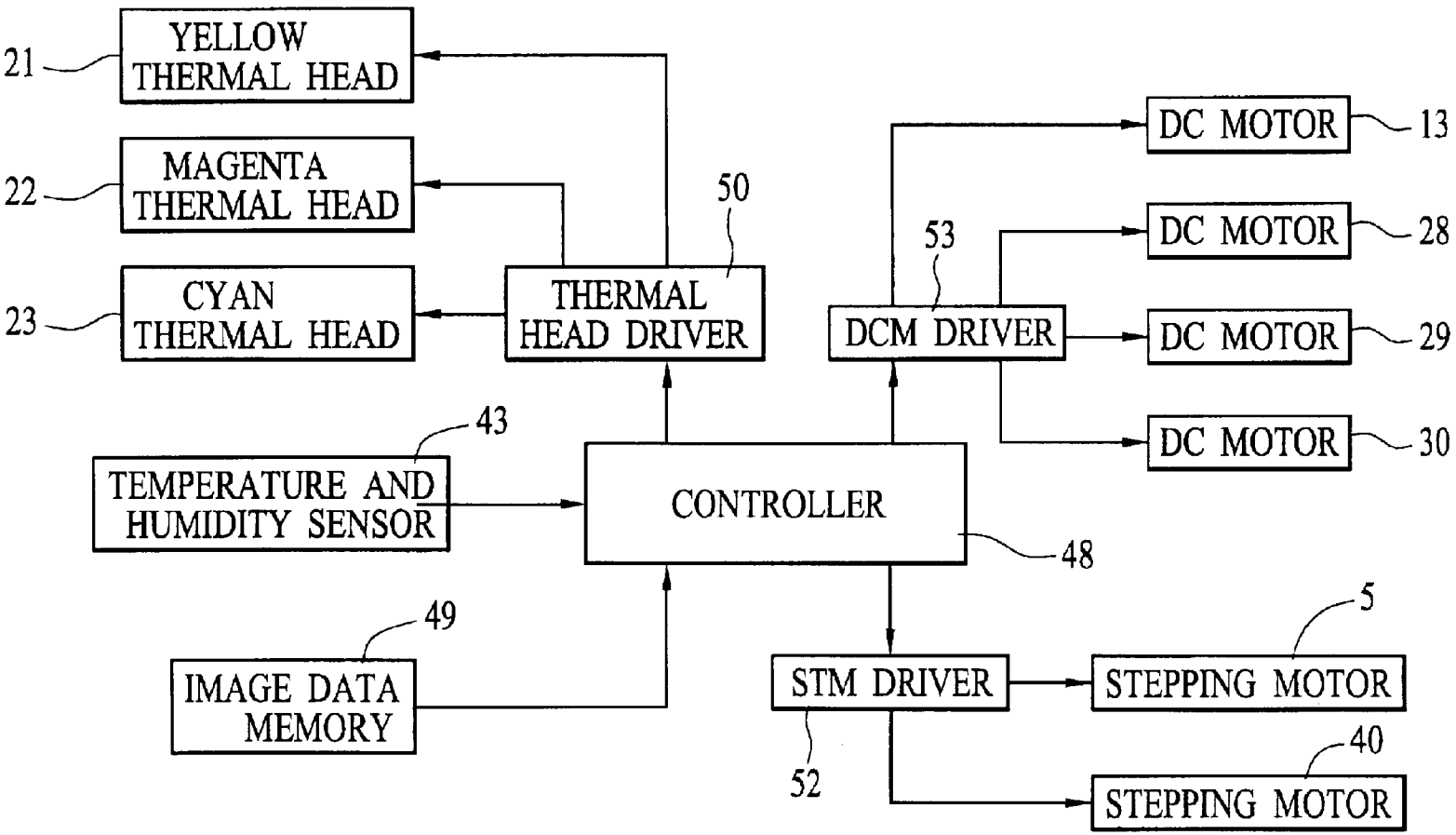
FIG. 2 is a block diagram of an electrical circuit of the color thermosensitive printer.

As shown in the block diagram in FIG. 2, the operation of the color thermosensitive printer is controlled by the controller 48 such as CPU. The THS 43, an image data memory 49, a thermal head driver 50, an STM driver 52 and a DCM driver 53 are electrically connected to the controller 48. The image data memory 49 stores image data from a digital camera, a personal computer, or the like. The controller 48 processes image data in the image data memory 49 to generate print data of yellow, magenta and cyan images based on image density of respective colors. These print data is sent to the head driver 50 that drives the yellow, magenta and cyan thermal heads 21, 22, 23.

The STM driver 52 drives the stepping motors 5, 40 by the control signals from the controller 48. The DCM driver 53 drives the DC motors 13, 28, 29, 30 by the control signals from the controller 48. The controller 48 calculates thermal energy applied to the recording sheet 2 by use of print data. The controller 48 decides the controls torque of the DC motors 13, 28, 29, 30 through the DCM driver 53 based on the temperature, humidity and thermal energy to the thermal heads.

The operation of the printer of the above embodiment is described below. In FIG. 1, the FTRP 25 applies tension Fy to the recording sheet 2. In the same manner, the FTRPs 26, 27 apply tension Fm, Fc to the recording sheet, respectively. The symbol Ff shows forward tension, applied to the downstream side of the conveyor roller pair 7, that is equal to the total of Fy, Fm, Fc. The symbol Fb shows backward tension applied to the recording sheet 2 by the BTRP 12.

When the print command is externally entered, the controller 48 activates the stepping motor 5 via the STM driver 52, and drives the THS 43 to measure the temperature and humidity. The feeding roller 4 rotates to feed the recording sheet 2 from the recording sheet roll 3 toward the conveyor roller pair 7. At the time when the leading end of the recording sheet 2 is between the feeding roller 4 and the BTRP 12, the pinch rollers 15, 9, 25*b*, 26*b*, 27*b* are apart from the corresponding capstan rollers 14, 8, 25*a*, 26*a*, 27*a*. Thus, the leading end of the recording sheet 2 is able to pass through the BTRP 12, conveyor roller pair 7 and FTRPs 25, 26, 27 without being caught between the capstan rollers and the pinch rollers.

When the leading end of the recording sheet 2 is detected by a sensor (not shown) located at a position downstream of the BTRP 12, the controller 48 activates the pinch roller 15 to press the recording sheet 2 with the capstan roller 14. Then, the controller 48 drives the DC motor 13 through the DCM driver 53 to rotate the capstan roller 14, so that the recording sheet 2 is conveyed toward the conveyor roller pair 7. The recording sheet 2 is hung around the correction roller 11.

The recording sheet 2 passes between the capstan roller 8 and the pinch roller 9. When the leading end of the recording sheet 2 is detected by a sensor (not shown) located at a position downstream of the conveyor roller pair 7, the controller 48 activates the pinch roller 9 to press the recording sheet 2 with the capstan roller 8. The conveyor roller 7 conveys the recording sheet 2 toward the yellow thermal head 21.

The recording sheet 2 passes the yellow thermal head 21 and the FTRP 25. When the leading end of the recording sheet 2 is detected by a sensor (not shown) located at a position downstream of the FTRP 25, the yellow thermal head 21 moves to the recording position. At the same moment, the pinch roller 25*b* is activated to press the recording sheet 2 the capstan roller 25*a*. Then, the controller 48 drives the DC motor 28 to rotate the capstan roller 25*a* of the FTRP, so that the conveyor roller 7 conveys the recording sheet 2 toward the magenta thermal head 22.

When the leading edge of the image recording area passes the yellow thermal head 21, the controller 48 drives the thermal head driver 50 to heat the heating element array of the yellow thermal head 21 based on yellow print data, so that a yellow image is recorded onto the yellow thermosensitive coloring layer.

Figures 3, 4:
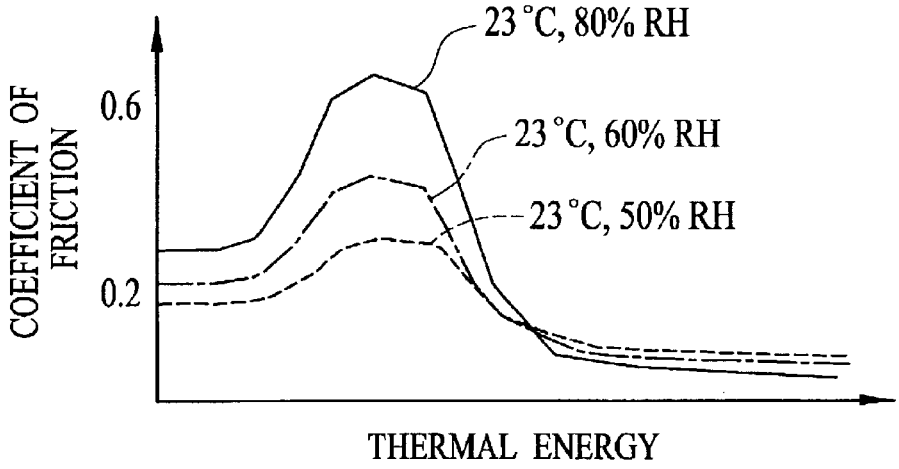
FIG. 3 is a table showing tension to a conveyor roller pair in recording an image of each color.
FIG. 4 is a graph showing a relationship between coefficient of friction and thermal energy, temperature and humidity.

The FTRP 25 applies tension to the recording sheet 2 to convey the recording sheet 2. Tension of the FTRP 25 is larger than the frictional force between the yellow thermal head 21 and the recording sheet 2, so that the recording sheet 2 is conveyed toward the yellow fixation lamp 32. As shown in FIG. 3, the FTRP 25 generates tension Fy to the recording sheet 2 between the thermal head 21 and the conveyor roller pair 7. Since the conveyor roller 7 presses the recording sheet 2 tightly, the conveyance speed of the recording sheet 2 is controlled by the conveyor roller pair 7. With strong tension, however, the recording sheet 2 is pulled downward so that the conveyance speed is fluctuated to cause unevenness in the recorded image. Moreover, strong tension of the FTRP 25 stretches the recording sheet 2, which causes deviation in the conveyance speed and the recording positions of the yellow image.

During the yellow image recording, the recording sheet 2 near the conveyor roller pair 7 receives tension Fy as forward tension Ff. In order to cancel the forward tension Ff, the controller 48 drives the BTRP 12 through the DC motor 13 to apply backward tension Fb that is equal to forward tension Ff.

As shown in FIG. 4, the coefficient of friction between the recording sheet 2 and the thermal head is variable in accordance with thermal energy, temperature, humidity, and so forth. Thermal energy of the thermal heads 21, 22, 23 is decided based on image density. If the coefficient of friction is changed from 0.2 to 0.5 under the pressing force of 8.0 kgf of the thermal head, for instance, the conveyor roller pair receives additional load of 2.4 kgf from the thermal head. This increase in load causes fluctuation in the conveyance speed of the recording sheet 2.

Figures 5, 7:
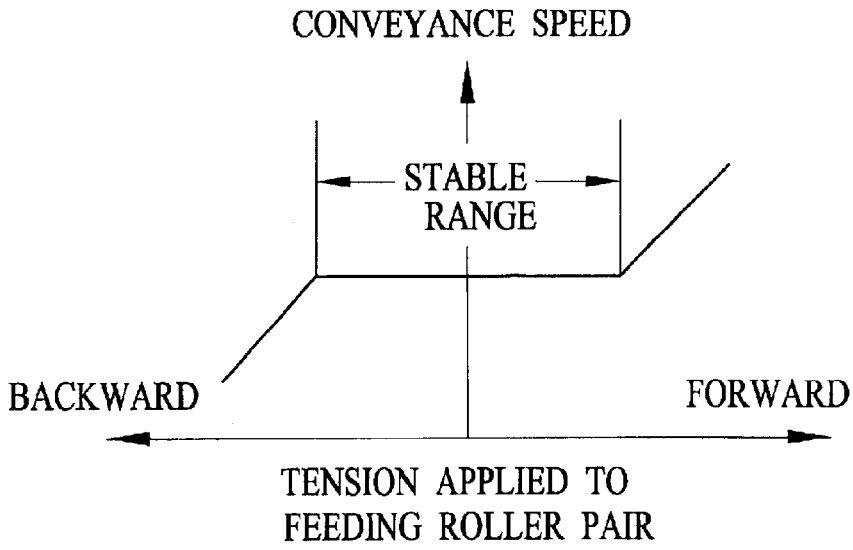
FIG. 5 is a table showing tension to a conveyor roller pair in recording an image of each color according to another embodiment.
FIG. 7 is a graph showing relationship between conveyance speed and tension to the conveyor roller pair.
Figure 6:
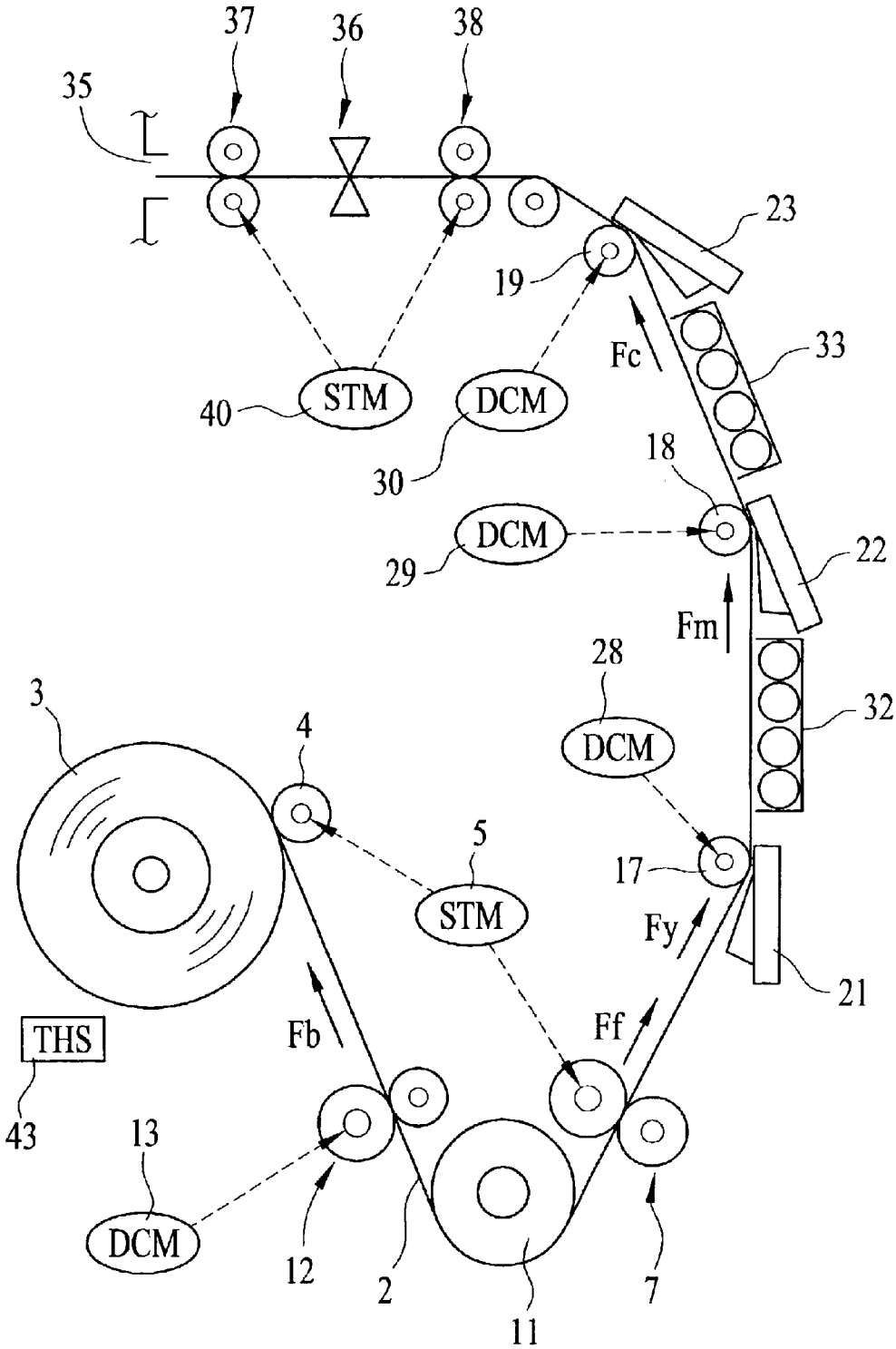
FIG. 6 is a schematic view showing a color thermosensitive printer with platen rollers to apply tension to the conveyor roller pair.

Thus, the controller 48 calculates the correction value $\alpha$ in consideration of the change in the coefficient of friction, and change backward tension Fb into $Ff \cdot \alpha = Fy \cdot \alpha$. Tension to the recording sheet 2 near the conveyor roller pair 7 is reduced to substantially zero, so that the conveyance speed of the recording sheet 2 is kept within the stable range shown in FIG. 7.

When the yellow thermal head 21 begins to record the yellow image, the yellow fixation lamp 32 is turned on. Near-ultraviolet rays with a peak about 420 nm is projected to the recording sheet 2 to fix the yellow thermosensitive coloring layer, thereby the yellow thermosensitive coloring layer is not colored during magenta and cyan image recording.

The FTRP 25 and the conveyor roller pair 7 convey the recording sheet 2 toward the magenta thermal head 26. When a sensor (not shown), located at a position downstream of the FTRP 26, detects the leading end of the recording sheet 2, the magenta thermal head 22 is moved to the recording position. At the same moment, the pinch roller 26*b* is activated to press the recording sheet 2 on the capstan roller 26*a*. Then, the controller 48 drives the DC motor 29 to rotate the capstan roller 26*a* of the FTRP 26, so that the recording sheet 2 is conveyed toward the cyan thermal head 23.

When the leading edge of the first image recording area passes the magenta thermal head 22, the controller 48 drives the thermal head driver 50 to heat the heating element array of the magenta thermal head 22 based on magenta print data. The magenta image is recorded onto the magenta thermosensitive coloring layer. At the same moment when the magenta image recording is started, the leading edge of the second image recording area passes the yellow thermal head 21. The controller 48 drives the yellow thermal head 21 to record the yellow image onto the yellow thermosensitive coloring layer in the second image recording area.

During the magenta image recording, the FTRP 26 applies tension Fm to the recording sheet 2 to convey the recording sheet 2, in the same manner as the yellow image recording. Since the magenta thermal head 22 presses the recording sheet 2 with the same force as the yellow thermal head 21, the controller 48 drives the FTRP 26 so that tension Fm is equal to tension Fy.

When the yellow image and the magenta image are recorded at the same time, the recording sheet 2 near the conveyor roller pair 7 receives tension Fy+Fm as forward tension Ff. In consideration of change in frictional force, the controller 48 drives the BTRP 12 to apply backward tension $Fb=(Fy+Fm)\alpha$. Forward tension Fy to the recording sheet 2 is reduced, and is kept in the stable range shown in FIG. 7.

When the magenta thermal head 22 begins to record the magenta image, the magenta fixation lamp 33 is turned on. Ultraviolet rays with a peak about 365 nm is illuminated on the recording sheet 2 to fix the magenta thermosensitive coloring layer, thereby the magenta thermosensitive coloring layer is not colored during cyan image recording. At the same moment, the yellow thermosensitive coloring layer in the second image recording area is fixed to the near-ultraviolet rays from the yellow fixation lamp 33.

When a sensor (not shown), located at a position downstream of the FTRP 27, detects the leading end of the recording sheet 2, the controller 48 moves the cyan thermal head 23 to the recording position. At the same moment, the pinch roller 27*b* is activated to press the recording sheet 2 the capstan roller 27*a*. Then, the controller 48 drives the DC motor 30 to rotate the capstan roller 27*a* of the FTRP 27, so that the recording sheet 2 is conveyed toward the ejection slot 35.

When the leading edge of the first image recording area passes the cyan thermal head 23, the controller 48 drives the cyan thermal head 23 based on magenta print data to record the cyan image onto the cyan thermosensitive coloring layer. At the same moment when the cyan image recording is started, the leading edge of the second and third image recording area passes the magenta and yellow thermal heads 22, 21, respectively. The controller 48 drives the magenta and yellow thermal heads 22, 21 to record the magenta and yellow image to the magenta yellow thermosensitive coloring layers in the second and third image recording area, respectively.

During the cyan image recording, the FTRP 27 applies tension Fy to the recording sheet 2 to convey the recording sheet 2, in the same manner as the yellow image recording. The controller 48 drives the FTRP 27 so that tension Fy of the FTRP 27 is equal to tension Fy, Fm. That is, the equation Fy=Fm=Fc is formed.

When the yellow, magenta and cyan images are recorded at the same time, the conveyor roller pair 7 receives tension Fy+Fm+Fc as forward tension Ff. In consideration of change in frictional force, the controller 48 drives the BTRP 12 to apply backward tension Fb=(Fy+Fm+Fc)α. Since forward tension Fy to the recording sheet 2 is kept in the stable range, it is possible to prevent deviation in the conveyance speed due to change in tension applied to the recording sheet 2. In recording an image onto the fourth image recording area or more, there is no rapid change in tension because all of the thermal heads 21, 22, 23 already press the recording sheet 2.

After the yellow, magenta and cyan images are recorded in the first image recording area of the recording sheet 2, the cutter 36 cut the first image recording area to produce a sheet print with a full-color image. The ejection roller 37 conveys the sheet print outside of the printer through the ejection slot 35.

In the above embodiment, tensions Fy, Fm, Fc are determined to be equal to one another. In order to convey the leading end of the recording sheet smoothly, it is possible to control the FTRPs 25, 26, 27 so that the recording sheet 2 receives larger tension in the downstream side. In the second embodiment shown in FIG. 5, the FTRP 25 applies tension Fy+Fr to the recording sheet 2. Fr is a set value so as to generate larger tension in the downstream side than in the upstream side.

In the magenta image recording, the controller 48 drives the FTRP 26 to apply tension Fm+Fr, and changes tension of FTRP 25 to Fy from Fy+Fr. Then, the forward tension Ff is equal to Fy+Fm+Fr. In the same manner, the controller 48 drives the FTRP 27 to apply tension Fc+Fr in the cyan image recording, and drives FTRP 26 to change its tension to Fm from Fm+Fr. Then, forward tension Ff becomes Fy+Fm+Fc+Fr. In order to reduce front tension Ff, the controller 48 drives the BTRP 12 to apply backward tension Fb that is equal to (Fy+Fm+Fc+Fr)α.

The controller 48 may drive the platen rollers 17, 18, 19 via the DC motors to apply forward tension Ff. In that case, it is possible to decrease the manufacturing cost by omitting the FTRPs 25, 26, 27, especially by omitting the grid rollers used for the capstan rollers 25*a*, 26*a*, 27*a*. Moreover, it is possible to reduce the margin between the adjacent image recording areas by canceling the distance between the thermal head and the FTRP. Thus, it is possible to record more image frames in a single recording sheet roll.

The color thermosensitive printer may have temperature and humidity sensors near the thermal heads to monitor the temperature and humidity more precisely. The controller may calculate the change in the coefficient of friction based on temperature and humidity information from the sensors near the thermal heads.

The present invention is applicable to a thermal transfer type printer to use yellow, magenta and cyan ink sheets, such as the sublimation type and the thermal melting type. The present invention is also applicable to a thermal transfer type printer to overcoat the yellow, magenta and cyan images on the recording sheet.

The present invention is not to be limited to the above embodiment but, on the contrary, various modifications will be possible to those skilled in the art without departing from the scope of claims appended hereto.

What is claimed is:

1. A color thermal printer having a conveyor roller pair and plural thermal heads that are arranged in a downstream side of said conveyor roller pair, said thermal heads recording a color image onto a recording sheet while said recording sheet is conveyed forward, said printer comprising:

plural forward tension roller pairs each of which is provided in a downstream side of said thermal head, said plural forward tension roller pairs nipping and applying forward tension to said recording sheet to convey said recording sheet downstream; and a backward tension roller pair provided in the upstream side of said conveyor roller pair, said backward tension roller pair applying backward tension to decrease said forward tension.

2. A thermal printer as claimed in claim 1, further comprising control means for controlling torque to said plural forward tension roller pairs and said backward tension roller pair so that said backward tension becomes substantially equal to the sum of said forward tension.

3. A thermal printer as claimed in claim 2, wherein said control means increases torque to said backward tension roller pair when one of said forward tension roller pair nips said recording sheet.

4. A thermal printer as claimed in claim 2, wherein said control means changes torque to said backward tension roller pair in accordance with image density of said image recorded by said thermal head.

5. A thermal printer as claimed in claim 2, further comprising measuring means for measuring temperature and/or humidity, said control means changing torque to said backward tension roller pair in accordance with information of said temperature and/or humidity.

6. A color thermal printer as in claim 2, wherein the plural forward tension rollers pairs and the backward tension roller pairs are configured so that the tension in the recording sheet near said conveyer roller pair is substantially zero.

7. A color thermal printer as in claim 1, wherein the plural forward tension rollers pairs and the backward tension roller pairs are configured so that the tension in the recording sheet near said conveyer roller pair is substantially zero.

8. A color thermal printer having a conveyor roller pair and plural thermal heads that are arranged in a downstream side of said conveyor roller pair, said thermal heads recording a color image onto a recording sheet while said recording sheet is conveyed forward, said printer comprising:

plural platen rollers each of which is provided in the position to face said thermal head, said recording sheet being nipped between said platen roller and said thermal head, said platen roller applying forward tension to said recording sheet to convey said recording sheet downstream;

a backward tension roller pair provided in the upstream side of said conveyor roller pair, said backward tension roller pair applying backward tension to decrease said forward tension; and control means for controlling torque to said platen rollers and said backward tension roller pair so that said backward tension becomes substantially equal to the sum of said forward tension.

9. A thermal printer as claimed in claim 8, further comprising control means for controlling torque to said platen rollers and said backward tension roller pair so that said backward tension becomes substantially equal to the sum of said forward tension.

10. A thermal printer as claimed in claim 9, wherein said control means increases torque to said backward tension roller pair when one of said platen roller nips said recording sheet.

11. A thermal printer as claimed in claim 9, wherein said control means changes torque to said backward tension roller pair in accordance with image density of said image recorded by said thermal head.

12. A thermal printer as claimed in claim 9, further comprising measuring means for measuring temperature and/or humidity, said control means changing torque to said backward tension roller pair in accordance with information of said temperature and/or humidity.

13. A color thermal printer as in claim 9, wherein the plural platen rollers pairs and the backward tension roller pairs are configured so that the tension in the recording sheet near said conveyer roller pair is substantially zero.

14. A color thermal printer as in claim 8, wherein the plural platen rollers pairs and the backward tension roller pairs are configured so that the tension in the recording sheet near said conveyer roller pair is substantially zero.

15. A thermal printing method for recording a color image by plural thermal heads that are arranged in a downstream side of a conveyor roller pair to convey said recording sheet forward, said method comprising steps of:

applying forward tension to said recording sheet near said thermal head to convey said recording sheet downstream;

applying backward tension to said recording sheet in the upstream side of said conveyor roller pair to decrease said forward tension; and controlling backward tension according to variation in said forward tension so that said backward tension becomes substantially equal to the sum of said forward tension.

16. A method as claimed in claim 15, wherein said forward tension is generated at plural forward tension roller pairs each of which is located in the downstream side of said thermal head.

17. A method as claimed in claim 15, wherein said forward tension is generated at plural platen rollers, said recording sheet is nipped between said thermal head and said platen rollers.

18. A thermal printing method for recording a color image by plural thermal heads that are arranged in a downstream side of a conveyor roller pair to convey said recording sheet forward, said method comprising steps of:

applying forward tension to said recording sheet near said thermal head to convey said recording sheet downstream;

applying backward tension to said recording sheet in the upstream side of said conveyor roller pair to decrease said forward tension; and controlling backward tension according to variation in the coefficient of friction between said recording sheet and said thermal head so that said backward tension becomes substantially equal to the sum of said forward tension.

19. A method as claimed in claim 18, wherein said forward tension is generated at plural forward tension roller pairs each of which is located in the downstream side of said thermal head.

20. A method as claimed in claim 18, wherein said forward tension is generated at plural platen rollers, said recording sheet is nipped between said thermal head and said platen rollers.

* * * * *